US006106242A

United States Patent [19]

Sung

[11] Patent Number: 6,106,242

[45] Date of Patent: Aug. 22, 2000

[54] HERMETIC ROTARY COMPRESSOR WITH RESONANCE CHAMBER

[75] Inventor: Chun-mo Sung, Suwon, Rep. of Korea

[73] Assignee: Samsung Electronics Co., Ltd., Suwon, Rep. of Korea

[21] Appl. No.: 09/232,163

[22] Filed: Jan. 15, 1999

[30] Foreign Application Priority Data

May 8, 1998 [KR] Rep. of Korea ..... 98-16477

[51] Int. Cl.[7] ..... F04B 53/00

[52] U.S. Cl. ..... 417/312; 418/181

[58] Field of Search ..... 417/312, 440, 417/441, 410.3; 418/181

[56] References Cited

U.S. PATENT DOCUMENTS

| | | | |
|---|---|---|---|
| 2,738,657 | 3/1956 | Jacobs | 417/312 X |
| 3,423,013 | 1/1969 | Rinehart | 417/410.3 X |
| 4,830,582 | 5/1989 | Asami et al. | 417/312 |
| 4,927,342 | 5/1990 | Kim et al. | 418/181 X |
| 5,074,761 | 12/1991 | Hirooka et al. | 417/440 X |
| 5,203,679 | 4/1993 | Yun et al. | 417/312 |

*Primary Examiner*—David J. Torrente
*Attorney, Agent, or Firm*—Burns, Doane, Swecker & Mathis, L.L.P.

[57] ABSTRACT

A hermetic rotary compressor includes a sealed case, an electrically-driven mechanism installed in the sealed case and a compressing mechanism for compressing the sucked-in refrigerant. The compressing mechanism has a cylinder defining a compression chamber into which an eccentric roller of the electrically-driven mechanism is accommodated. Upper and lower flanges are respectively fixed to upper and lower portions of the cylinder so as to support the rotary shaft and seal the compression chamber. At least one resonance chamber is formed at an inner peripheral surface of a discharge port formed in the upper flange, whereby the resonance chamber communicates with the discharge port. A closure member is provided for opening/closing the resonance chamber. The closure member is biased closed by a spring disposed in a hole formed at the inner peripheral surface of the discharge port of the upper flange, the hole and resonance chamber having a common entrance. The resonance chamber is opened during a compression operation and is closed when the refrigerant is discharged by the closure member.

4 Claims, 6 Drawing Sheets

HERMETIC ROTARY COMPRESSOR WITH RESONANCE CHAMBER

BACKGROUND OF THE INVENTION

1. Field of the Invention

The present invention relates to a hermetic rotary compressor.

2. Description of the Prior Art

Generally, a hermetic rotary compressor compresses a refrigerant which has passed through an evaporator and introduces the compressed refrigerant to a condenser.

As shown in FIG. 1, such compressor has a sealed case 10, an electrically-driven mechanism 20, and a compressing mechanism 60. The electrically-driven mechanism 20 is provided into the case 10, and compressing mechanism 60 rotates so as to compress the refrigerant by means of a driving force generated from the electrically-driven mechanism 20.

A discharge pipe 12 is connected to an upper portion of the sealed case 10, while a suction pipe 16 is connected to a lower portion of the sealed case 10. An accumulator 14 is connected with the suction pipe 16.

The electrically-driven mechanism 20 has a stator 22 and a rotor 24. The stator 22 is fixed to an inner peripheral surface of the case 10. Additionally, the rotor 24 is rotatably installed inside the stator 22 and has a predetermined interval with the stator 22. A rotary shaft 24*a* is press-fitted into the rotor 24. One end of the rotary shaft 24*a* projects toward the compressing mechanism 60.

In addition, the compressing mechanism 60 has an eccentric section 28 provided at the rotary shaft 24*a*, a roller 26 surrounding the eccentric section 28, and a cylinder 30 defining a compression chamber 30*a* into which the roller 26 is received. As shown in FIGS. 2 and 3, a cutaway section 30*b* is formed in an inner peripheral surface of the cylinder 30. The cutaway section 30*b* has a vane 32 for dividing the compression chamber 30*a* into a suction space B and a compression space A. The cylinder 30 is also formed with a resonance chamber 30*c* and a suction hole 30*d* with the vane 32 disposed therebetween. One end of the vane 32 is in linear contact with the outer peripheral surface of the roller 26, while the other end thereof is connected with a spring 34 whose one end is connected with the cutaway section 30*b*. Additionally, the resonance chamber 30*c* is formed at the compression space A of the compression chamber 30*a*, while the suction hole 30*d* is formed at the suction space B of the compression chamber 30*a*. Meanwhile, the cylinder 30 is fixed to upper and lower end flanges 36 and 38 disposed respectively at the upper and the lower portions thereof. A discharge port 36*a* is formed in the upper end flange 36 while communicating with the compression space A so as to permit the refrigerant to be discharged therethrough. Also, a discharge valve 40 is positioned at the upper end flange 36 so as to open/close the discharge port 36*a*.

Thus, the hermetic rotary compressor constructed as described above compresses the refrigerant into the liquefied high temperature and high pressure refrigerant as explained below. First, as the electrically-driven mechanism 20 operates, the rotor 24 rotates at a high velocity. Accordingly, the roller 26 surrounding the eccentric section 28 of the rotary shaft 24*a* rotates within the compression chamber 30*a* of the cylinder 30.

In this situation, the refrigerant is sucked into the suction space B of the compression chamber 30*a* subsequently through the accumulator 14, the suction pipe 16 and then through the suction hole 30*d* which are connected therewith.

Supposing that the suction hole 30*d* is a reference point, i.e., a zero degree (0°), the refrigerant is compressed into the high temperature and high pressure refrigerant when the roller 26 orbits from a two hundred and twelve degree point to a two hundred and twenty degree point (212°–220°). Then, when the roller further orbits to a three hundred and thirty degree point (330°), the discharge valve 40 disposed at the upper flange 36 is open so as to permit the refrigerant to be discharged through the discharge port 36*a*. The maximum compression noise generated during rotation of the roller 26 from the two hundred and twenty degree point to the three hundred and thirty degree point (220°–330°) is reduced by the resonance chamber 30*c* of the cylinder 30 which is so formed at the resonance chamber 30*c* as to communicate with the compression space A.

In the conventional hermetic rotary compressor, the structure for reducing the noise generated during the refrigerant compressing operation, i.e., the resonance chamber 30*c* is formed in the inner peripheral surface of the cylinder 30 so as to communicate with the compression space A. This means that the compressed refrigerant is not completely discharged through the discharge port; rather, some of the refrigerant is introduced into the resonance chamber which functions as a 'Dead volume'. Accordingly, the discharge pressure becomes lower, and the compressor performance is reduced.

SUMMARY OF THE INVENTION

The present invention has been made to overcome above mentioned problem, and accordingly it is an object of the present invention to provide a hermetic rotary compressor for reducing the discharge loss and for preventing a lowering of the discharge pressure while reducing the compression noise so as to improve the performance thereof.

The above-mentioned object is accomplished by the hermetic rotary compressor according to the present invention comprising at least one resonance chamber formed at an inner peripheral surface of a discharge port of an upper end flange so as to communicate with the discharge port. The resonance chamber reduces the noise generated during a refrigerant compressing operation. Additionally, the hermetic rotary compressor according to the present invention comprises a closure member for selectively opening/closing the resonance chamber. Further, the resonance chamber closure member comprises a hole formed at the inner peripheral surface of the discharge port, the closure comprising an opening/closing plate disposed at an entrance of the hole, and an elastic member disposed in the hole for biasing the closure member to a closed position. Such a resonance chamber opening/closing plate opens the resonance chamber during a compressing operation, as the opening/closing plate is pushed open against the bias of the elastic member by the pressure of the compressed refrigerant, and then closes the resonance chamber during a discharge of the refrigerant, as the opening/closing plate is returned to its initial position by the restoring force of the elastic member.

Accordingly, not only is there less noise during a refrigerant compressing operation, but also the diminishing of discharge pressure is prevented. As a result, the performance of the compressor is improved.

BRIEF DESCRIPTION OF THE DRAWINGS

The above object and advantage will be more apparent by describing the present invention with reference to the reference drawing accompanied, in which.

DETAILED DESCRIPTION OF THE PREFERRED EMBODIMENT

Figure 1:
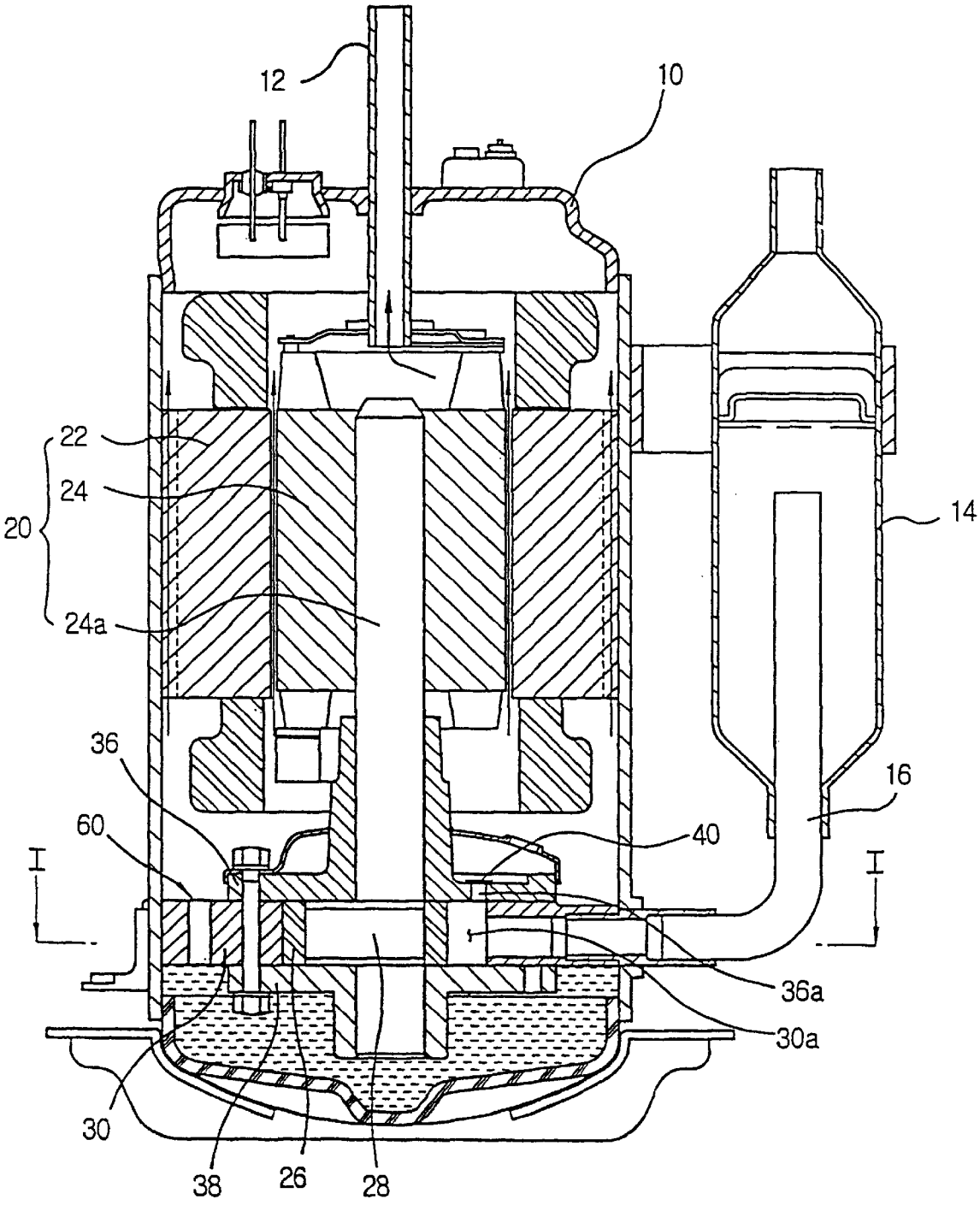
FIG. 1 (PRIOR ART)
FIG. 1 is a cross sectional view schematically showing a conventional hermetic rotary compressor.
Figure 2:
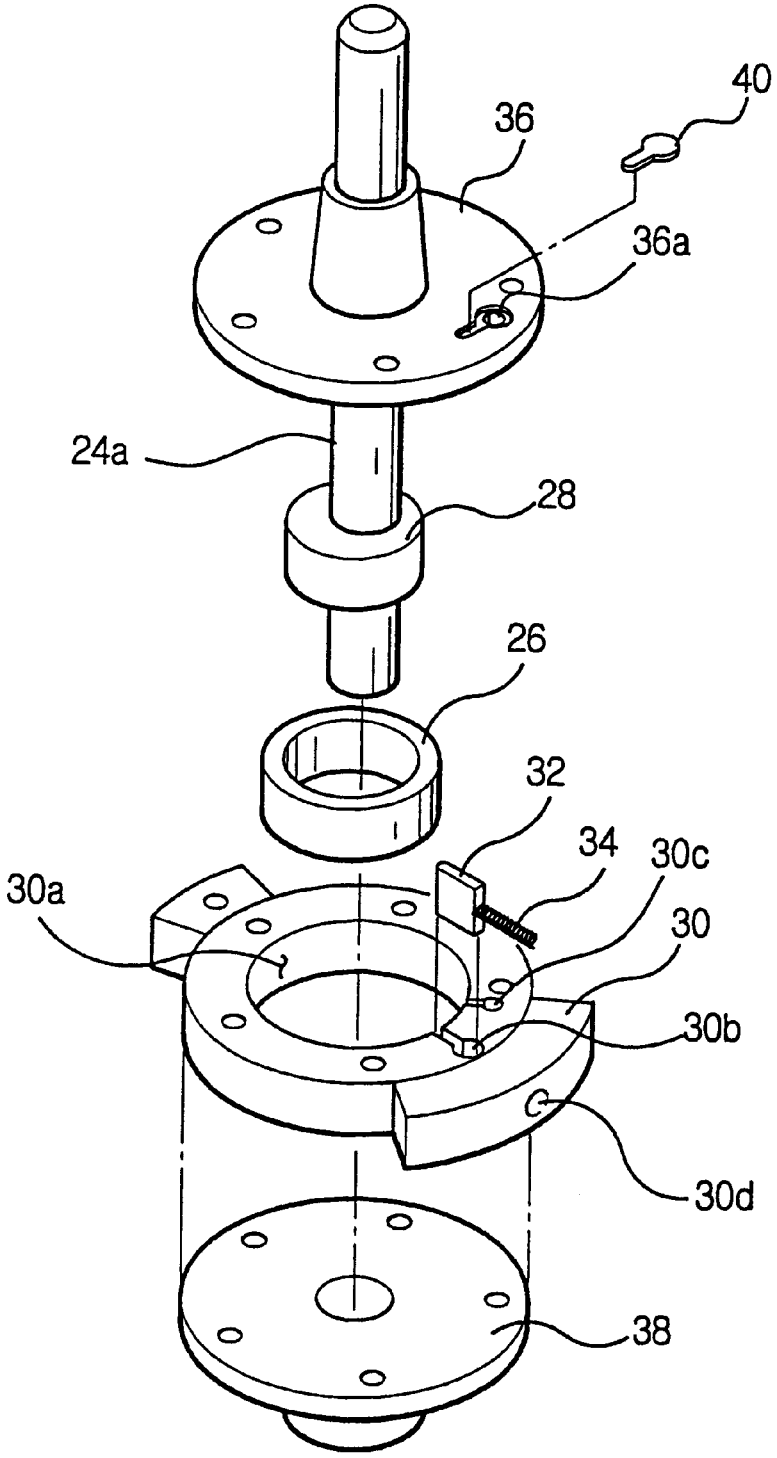
FIG. 2 (PRIOR ART)
FIG. 2 is an exploded perspective view showing a main part of the hermetic rotary compressor of FIG. 1.
Figure 3:
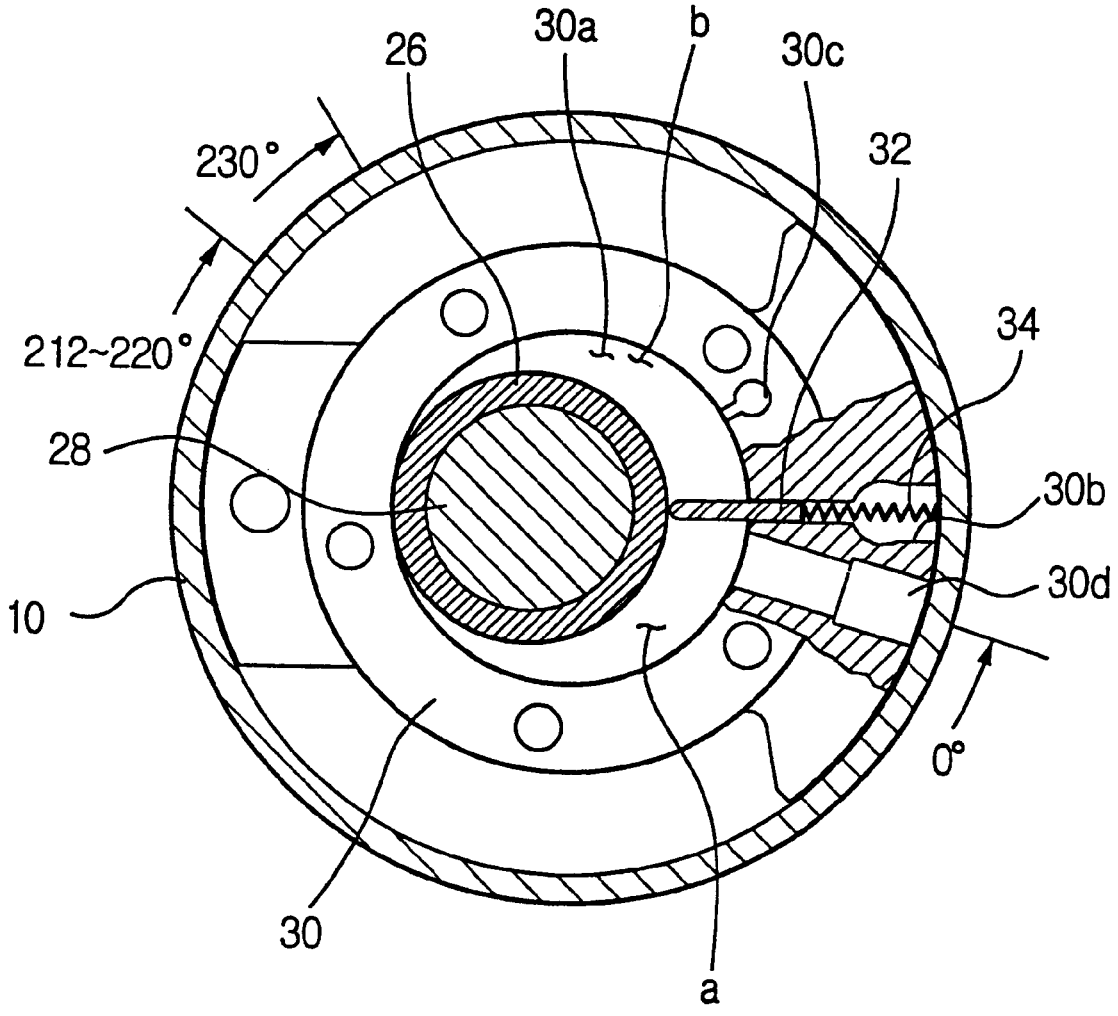
FIG. 3 (PRIOR ART)
FIG. 3 is a cross sectional view showing the conventional hermetic rotary compressor of FIG. 1, taken along the line I—I.
Figure 4:
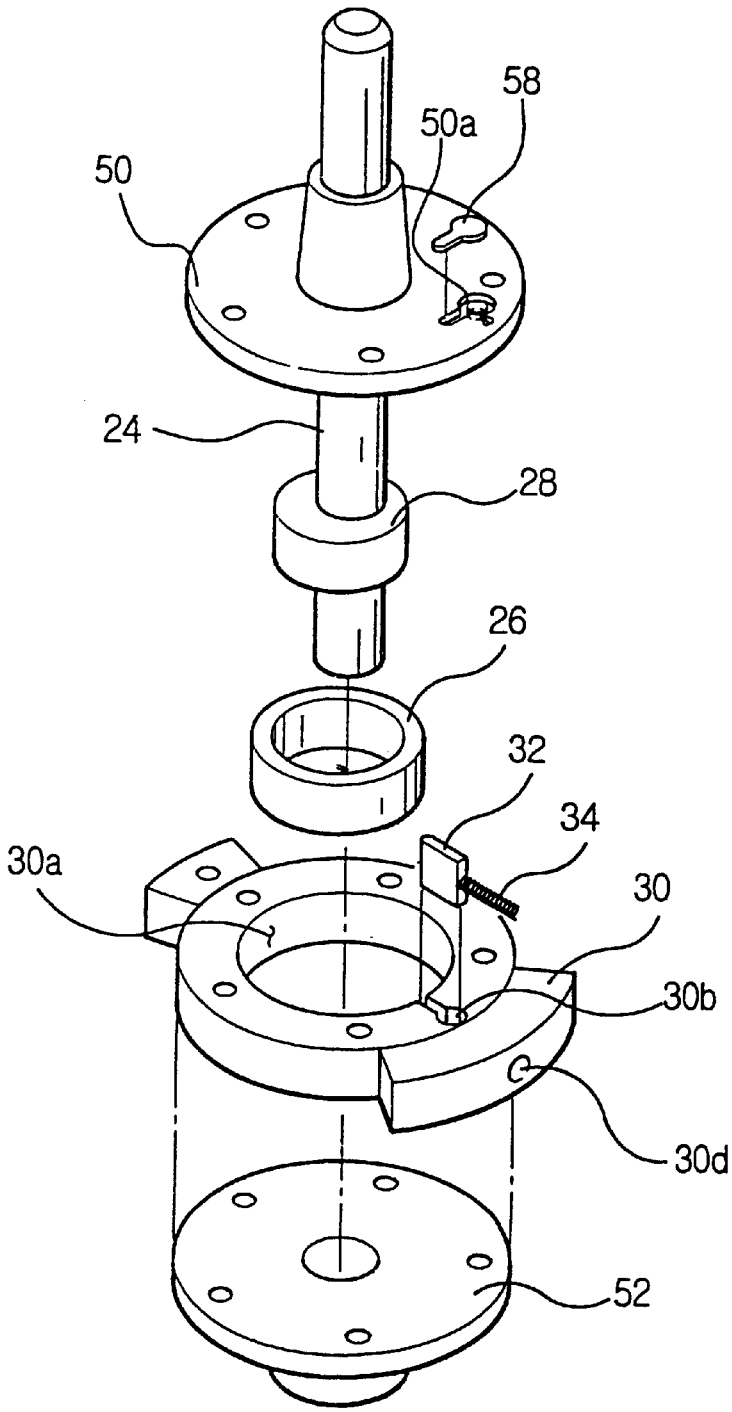
FIG. 4 is an exploded perspective view showing a main part of a hermetic rotary compressor according to the preferred embodiment of the present invention.
Figure 4A:
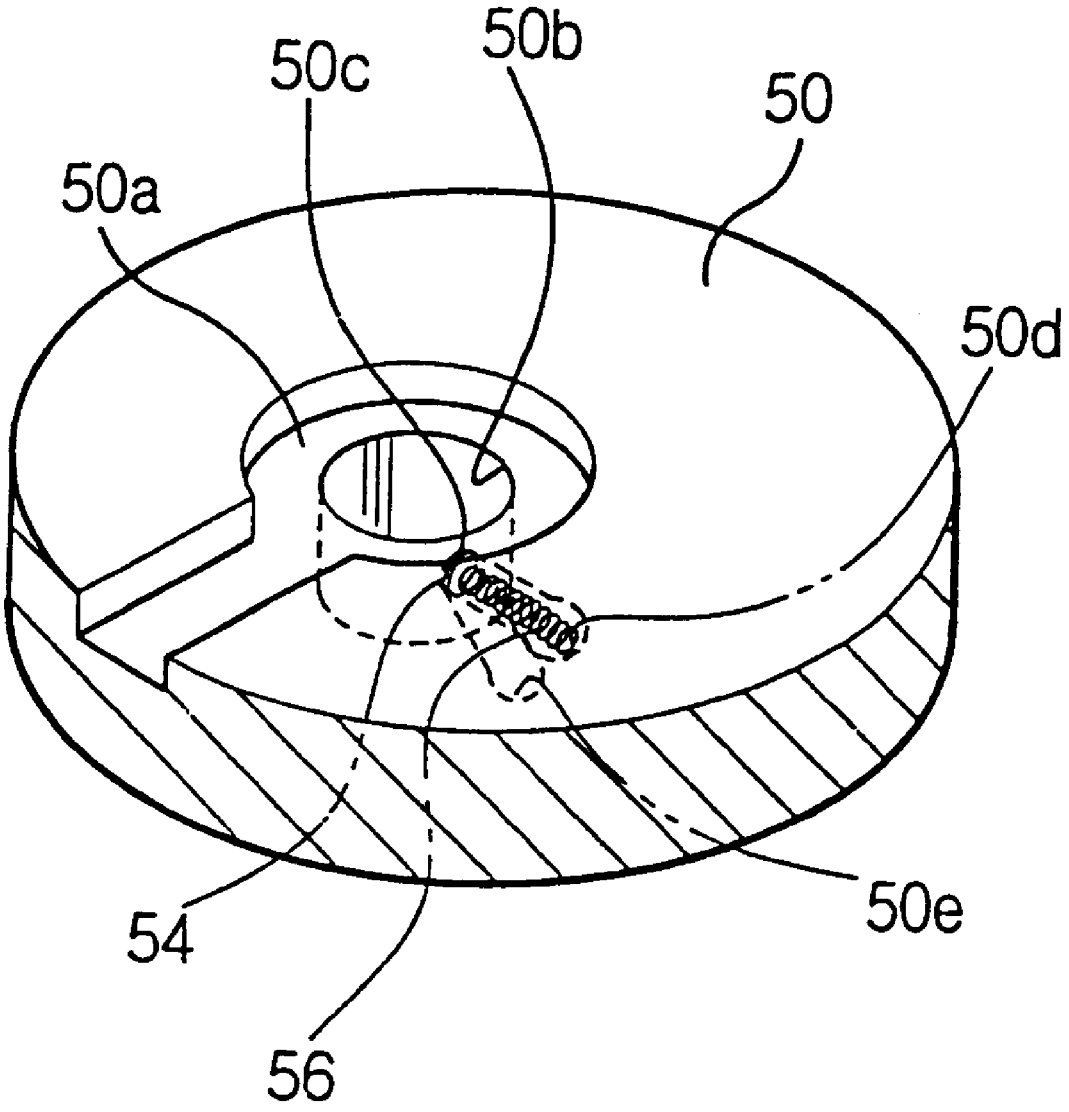
FIG. 4*a* is an enlarged fragmentary view of a resonance chamber according to the invention.
Figure 5:
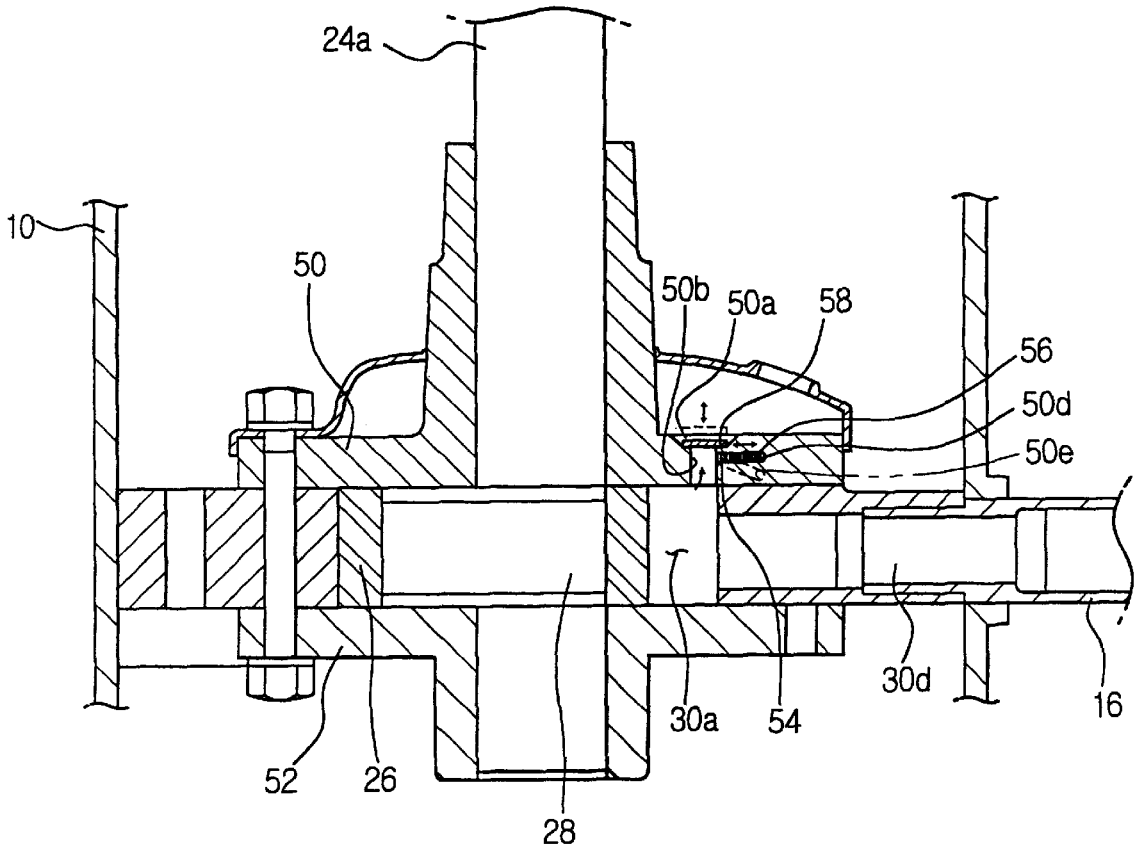
FIG. 5 is a cross sectional view showing a main part of the hermetic rotary compressor of FIG. 4.

As shown in FIGS. 1, 4, and 5, a hermetic rotary compressor according to the preferred embodiment of the present invention includes a sealed case 10, an electrically-driven mechanism 20, and a compressing mechanism 60. The electrically-driven mechanism 20 is provided to an inner portion of the case 10, and the compressing mechanism 60 rotates so as to compress the refrigerant with the driving force transmitted from the electrically-driven mechanism 20.

A discharge pipe 12 is connected to an upper portion of the case 10, while a suction pipe 16 is connected to a lower portion thereof. The suction pipe 16 is also connected with an accumulator 14.

The electrically-driven mechanism 20 includes a stator 22 and a rotor 24. The stator 22 is press-fitted to an inner peripheral surface of the case 10, while the rotor 24 is rotatably installed inside the stator 22 and has a predetermined interval with the stator 22. Additionally, a rotary shaft 24*a* is press-fitted into the rotor 24. One end of the rotary shaft 24 projects toward the compressing mechanism 60.

The compressing mechanism 60 includes an eccentric section 28 provided at the rotary shaft 24*a*, a roller 26 surrounding the eccentric section 28, and a cylinder 30 defining a compression chamber 30*a* into which the roller 26 is accommodated. A cutaway section 30*b* is formed in the inner peripheral surface of the cylinder 30. The cutaway section 30*b* is provided with a vane 32 for dividing the compression chamber 30*a* into a suction space B and a compression space A. One end of the vane 32 is in linear contact with the outer peripheral surface of the roller 26, while the other end thereof is connected with a side of a spring 34. In addition, a suction hole 30*d* is formed in the cylinder 30 while communicating with the suction space B of the compression chamber 30*a*. The suction hole 30*d* is connected with the suction pipe 16.

Meanwhile, the upper and lower portions of the cylinder 30 are respectively fixed to upper and lower end flanges 50 and 52 by bolts. The upper and lower end flanges 50 and 52 support the rotary shaft 24*a* and seal the compression chamber 30*a* of the cylinder 30.

A discharge seat 50*a* is formed in the upper end flange 50 while having a predetermined depth. The discharge seat 50*a* is formed with a discharge port 50*b* communicating with the compression space A of the compression chamber 30*a*. Also, the discharge port 50*b* has a cutaway hole 50*d* and an adjacent resonance chamber 50*e* which the cutaway hole 50*d* and chamber 50*e* have a common entrance 50*c*.

The discharge port 50*b* is provided with a resonance chamber opening/closing member for selectively opening/closing the resonance chamber 50*e*. The resonance chamber opening/closing member includes the cutaway hole 50*d*, an opening/closing plate 54, and an elastic member 56. The opening/closing plate 54 is disposed at the entrance 50*c* of the cutaway hole 50*d*. The elastic member 56 is disposed within the cutaway hole 50*d* and elastically biases the opening/closing plate 54 toward an initial closing position. Also, the discharge seat 50*a* has fixed thereto one end of a discharge valve 58 for opening/closing the discharge port 50*b*.

One or more resonance chambers 50*e* may be formed at lower, or right or left sides of the cutaway hole 50*d*, provided it does not reduce the energy consumption efficiency of the compressor.

The operation of the hermetic rotary compressor according to the preferred embodiment of the present invention will be described in greater detail hereinbelow.

In order to compress the refrigerant into a liquefied high temperature and high pressure refrigerant, the electrically-driven mechanism 20 operates so that the refrigerant introduced to the accumulator 14 is sucked into the compression chamber 30*a* of the cylinder 30 through the suction pipe 16 and suction hole 30*d*.

Then, the refrigerant sucked into the suction space B of the compression chamber 30*a* is compressed as the roller 26 surrounding the eccentric section 28 of the rotary shaft 24*a* orbits within the compression chamber 30*a*. Such compressed refrigerant is discharged through the discharge port 50*b* of the upper end flange 50 as the roller 26 orbits to the three hundred and thirty degree point (330°).

At this instance, the opening/closing plate 54 disposed within the entrance 50*c* opens the resonance chamber 50*e* by being pushed by the discharge pressure toward the cutaway hole 50*d* as the second elastic member 56 is compressed.

As the refrigerant is discharged, the discharge valve 58 returns to the initial position by the external pressure and closes the discharge port 50*b*. Simultaneously, the opening/closing plate 57 is returned to the initial position by the restoring force of the elastic member 56 so that the opening/closing plate 57 closes the resonance chamber 50*e*.

As described, according to the present invention, the resonance chamber is in an open state during the compressing operation. Then, when the discharge valve opens, the resonance chamber is closed. Accordingly, the noise generated during the compressing operation is reduced, and the lowering of the discharge pressure is prevented.

While the present invention has been particularly shown and described with reference to the preferred embodiment thereof, it will be understood by those skilled in the art that various changes in form and details may be effected therein without departing from the spirit and scope of the invention as defined by the appended claims.

What is claimed is:

1. A hermetic rotary compressor comprising:

a sealed case;

an electrically-driven mechanism installed in the sealed case and including a rotor shaft having an eccentric portion;

a compression mechanism for compressing a refrigerant, the compression mechanism having a cylinder defining a compression chamber into which the eccentric section of the rotary shaft is accommodated;

first and second end flanges fixed to respective end portions of the cylinder so as to support the rotary shaft and seal the compression chamber, one of the first and second end flanges including a discharge port for discharging compressed refrigerant from the compression chamber;

at least one resonance chamber formed at an inner peripheral surface of the discharge port, the resonance chamber communicating with the discharge port for reducing noise generated during compression of the refrigerant; and a closure member for selectively opening/closing the resonance chamber.

2. The hermetic rotary compressor as claimed in claim 1, wherein the resonance chamber is opened during a compressing operation and closed in response to an opening of the discharge valve by the closure member.

3. The hermetic rotary compressor as claimed in claim 2, wherein the closure member comprises a cutaway hole formed at the inner peripheral surface of the discharge port of the one end flange while having a common entrance with the resonance chamber, an opening/closing plate disposed at the entrance, and an elastic member disposed in the cutaway hole for biasing the opening/closing plate so as to close the resonance chamber.

4. The hermetic rotary compressor as claimed in claim 1, wherein the first and second flanges are disposed at upper and lower portions, respectively, of the cylinder, the one end flange being the first flange.

* * * * *